US007040733B2

(12) United States Patent
Hin

(10) Patent No.: US 7,040,733 B2
(45) Date of Patent: May 9, 2006

(54) DETERMINING A POSITION OF AN OPTICAL SENSOR ASSOCIATED WITH A PRINTHEAD RELATIVE TO A PRINT MEDIA

(76) Inventor: Colin Chee Chong Hin, 8 Lebuh Pekaka, 2 Tamen Pekaka, 11700, Penang (MY)

( * ) Notice: Subject to any disclaimer, the term of this patent is extended or adjusted under 35 U.S.C. 154(b) by 37 days.

(21) Appl. No.: 10/628,911

(22) Filed: Jul. 28, 2003

(65) Prior Publication Data

US 2005/0024414 A1 Feb. 3, 2005

(51) Int. Cl.
*B41J 29/393* (2006.01)
*B41J 3/407* (2006.01)

(52) U.S. Cl. ..... 347/19; 347/106

(58) Field of Classification Search ..... 347/14, 347/19, 37, 116; 400/705, 705.1, 705.3, 400/706, 706.1, 707, 708, 709
See application file for complete search history.

(56) References Cited

U.S. PATENT DOCUMENTS 5,127,752 A * 7/1992 Courtney ..... 400/342
5,397,192 A * 3/1995 Khormaee ..... 400/708
6,604,808 B1 * 8/2003 King et al. ..... 347/19

FOREIGN PATENT DOCUMENTS

GB 2356600 A 9/2000
GB 2379414 A * 3/2003

* cited by examiner

*Primary Examiner*—Thinh Nguyen

(57) ABSTRACT

Described are systems and methods for printing that use an optical sensor that is moveable relative to a print medium, and a mark that is visible to the optical sensor within the range of movement of the optical sensor. The mark provides a fixed and known location that can be used to establish a position of the optical sensor relative to the print medium.

17 Claims, 8 Drawing Sheets

DETERMINING A POSITION OF AN OPTICAL SENSOR ASSOCIATED WITH A PRINTHEAD RELATIVE TO A PRINT MEDIA

TECHNICAL FIELD

Embodiments of the present invention relate to systems and methods for accurately determining a position of an optical sensor. More specifically, embodiments of the present invention pertain to printer systems that utilize optical sensors to determine a position of an optical sensor associated with a printhead relative to a print media.

BACKGROUND ART

As a general description, printers function by depositing ink from a printhead horizontally across a print medium (e.g., a page of paper). The page is advanced to its next position, and ink is applied horizontally to another part of the page. There may also be instances in which ink is applied repeatedly to the same part of a page. In any case, it is important that the printhead be accurately located relative to the page, in order to deliver ink to precise locations on the page. The inability to accurately deliver ink can cause discernible defects on the printed page.

Optical navigation technology (ONT) provides a mechanism that can be implemented in printer systems to determine relative positioning of the printhead and print medium. Applying ONT to printers involves very rapidly capturing multiple successive images of the surface of the print medium. The images can be compared, differences can be identified and analyzed, and the differences can be used to calculate the change in position from a previously calculated position.

Some ONT-based systems that can be used in printers rely on the features and patterns of the print medium to determine displacement of the print medium. These types of systems can be based on the fact that blank white paper, for example, is not uniform when observed at high, magnification. By taking advantage of the non-uniformity of the paper, patterns in the paper can be detected and used to identify a location on the page. While innovative, these types of systems can give inconsistent results.

Other ONT-based systems that can be used in printers use distinct surface characteristics or patterns, such as alphanumeric characters appearing on the print medium, to more precisely navigate the print medium. A first image of the print medium can be obtained, followed a short time later by the acquisition of a second image different from the first. Although different, the two images have some area of commonality. The difference between the two images indicates how far the printhead has traveled, allowing for its location to be accurately determined.

The images of the print medium can be obtained using an imager or photo array. More precise navigation can be obtained by increasing the size of the photo array. With a larger photo array, the signal-to-noise ratio is increased, allowing the relative position of the printhead and the print medium to be more accurately deduced.

However, larger photo arrays are problematic because they are costly. Also, fabrication of larger photo arrays means larger dies and fewer dies per wafer. Larger dies are more susceptible to spot defects on the wafer, so the fraction of defective photo arrays per wafer will increase.

Thus, it is desirable to improve navigation accuracy without increasing the size of the photo array.

DISCLOSURE OF THE INVENTION

Embodiments of the present invention pertain to systems and methods for printing using an optical sensor that is moveable relative to a print medium, and a mark that is visible to the optical sensor within the range of movement of the optical sensor. The mark provides a fixed and known location that can be used to establish a position of the optical sensor relative to the print medium.

In one embodiment, a method of correcting a position of a printhead in a system for printing is described. An initial position of the printhead is established. A second position of the printhead is estimated based on information sensed as the printhead moves relative to a print medium. A first marker in a known location is used to determine-an error associated with the second position.

In another embodiment, a method of detecting rotational mounting error between an optical sensor and a printhead in a system for printing is described. A signal that identifies a direction of relative motion between the optical sensor and printhead, moving in combination, and a print medium is received. A position of the optical sensor and printhead is estimated using information sensed from the print medium. Any difference between a position of the optical sensor and printhead based on the direction of relative motion, and the position of the optical sensor and printhead estimated using the information sensed from the print medium, is identified. The difference, if it is exists, indicates presence of a rotational mounting error.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to various embodiments of the invention, examples of which are illustrated in the accompanying drawings. The drawings referred to in this description should not be understood as being drawn to scale except if specifically noted.

Figure 1:
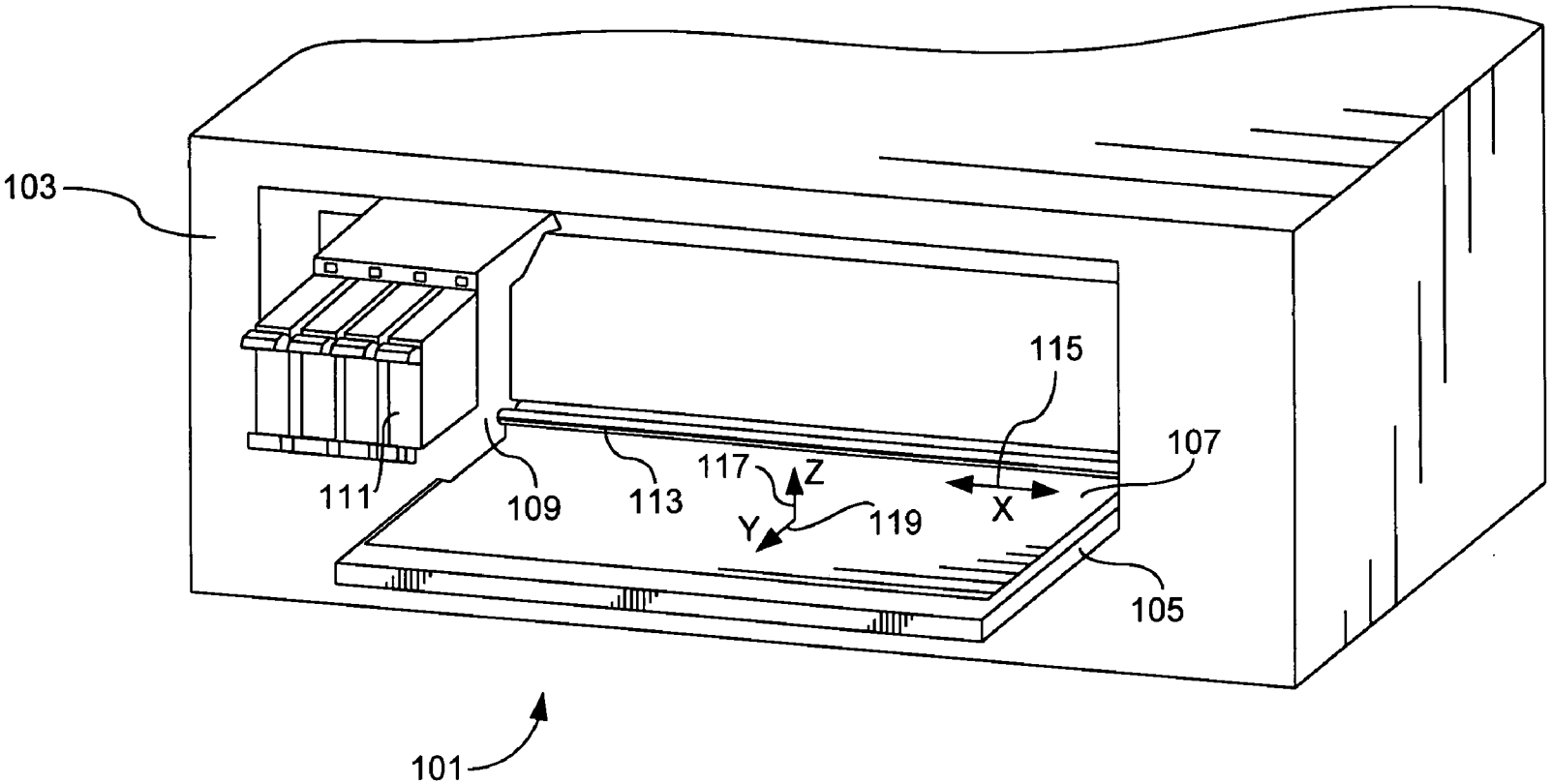
FIG. 1 illustrates an exemplary printer system upon which embodiments of the present invention can be implemented.

FIG. 1 is a perspective diagram (partial cut-away) of an exemplary printer system 101 upon which embodiments of the present invention can be implemented. Exemplary printer system 101 includes a printer housing 103 having a platen 105 to which print media 107 (e.g., paper) is transported by a feed mechanism. The feed mechanism is more fully described in conjunction with FIGS. 2A, 3A, 3B and 4.

Exemplary printer system 101 of FIG. 1 also includes a carriage 109 holding at least one replaceable printer component 111 (e.g., a printer cartridge) for ejecting fluid such as ink onto print media 107. Carriage 109 is mounted on a slide bar 113 or similar mechanism to allow the carriage 109 to be moved along a scan axis, X, denoted by arrow 115. Also, during operation, print media 107 is moved along a feed axis, Y, denoted by arrow 119. Often, print media 107 travels along the feed axis, Y, while ink is ejected along an ink drop trajectory axis, Z, as shown by arrow 117.

Although such an exemplary printer system 101 is shown in FIG. 1, embodiments of the present invention are well suited to use with various other types of printer systems. Aspects of the present invention may also find applications in devices and systems other than printer systems.

Figure 2A:
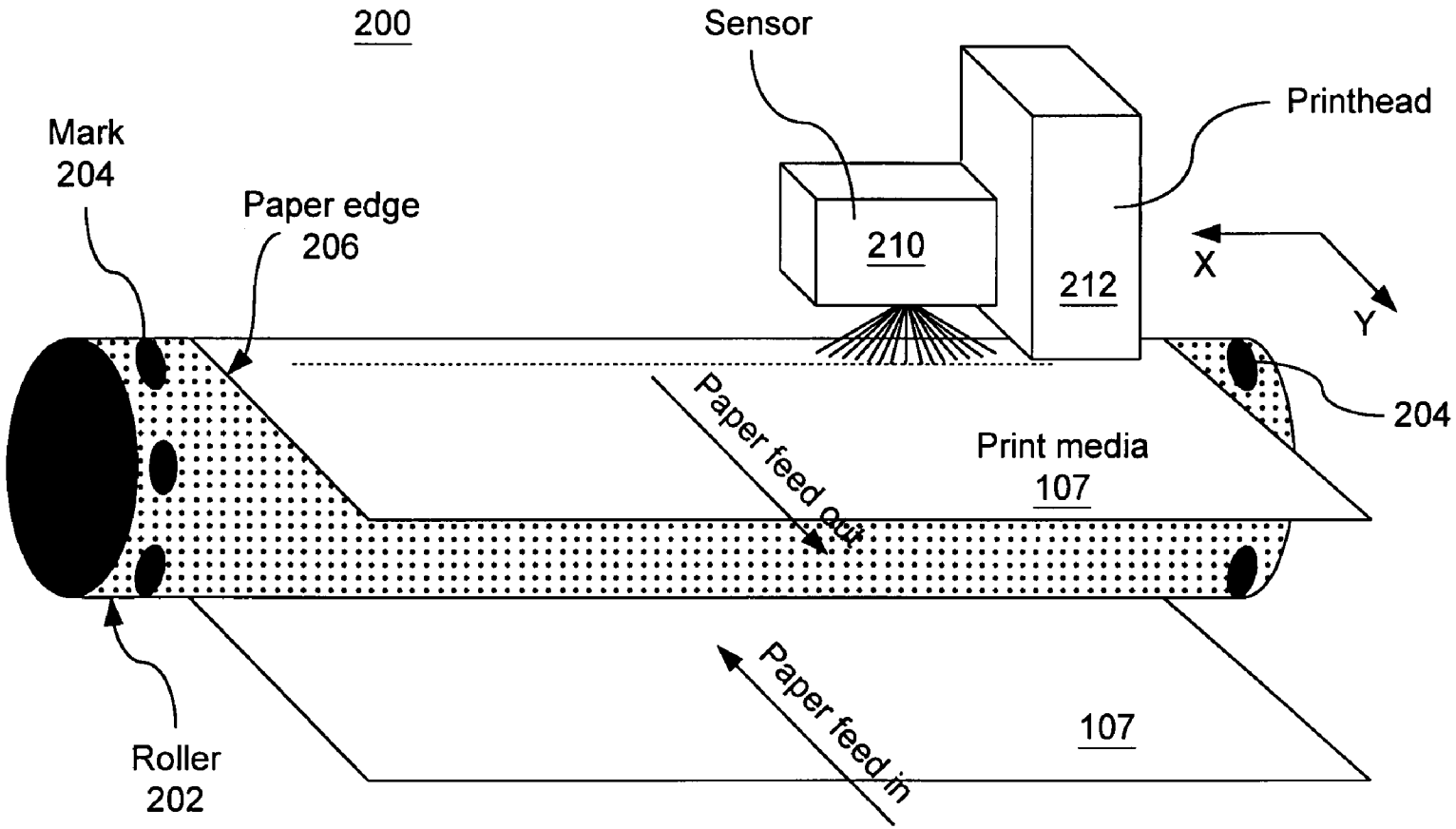
FIG. 2A illustrates a print medium feed mechanism with calibration marks according to one embodiment of the present invention.

FIG. 2A illustrates a print medium feed mechanism 200 according to one embodiment of the present invention. Print media 107 is fed around a roller 202 in the general direction Y.

Printhead 212 dispenses fluid such as ink onto print media 107. An optical sensor 210 is coupled to the printhead 212. In general, the printhead 212 and the optical sensor 210 move in tandem along a slide bar or the like along the axis X. In general, the direction of travel of optical sensor 210 and printhead 212 is essentially orthogonal to the direction of travel of print media 107.

Optical sensor 210 can also be referred to as an optical encoder, an imager, a photo diode array, an photo transistor array, a charge coupled device, or a complementary metal-oxide semiconductor imager. Optical sensor 210 functions to sense information from the print media 107 and also from roller 202. The information sensed from print media 107 includes, but is not limited to, the characteristics of the input media itself (e.g., the texture of the paper), the characteristics of information printed on the input media (e.g., alphanumeric characters printed on the page), the positions of ink dots on the page, and the density of the ink dots. According to the present embodiment, optical sensor 210 senses the marks 204 from roller 202. The function of the marks 204 is more fully described below.

Optical sensor 210 can include a mechanism for illuminating the print media 107 and roller 202, or this type of mechanism can be provided by a separate element. Optical sensor 210 can include a memory for storing sensed information, a controller or similar device for analyzing and interpreting the sensed information, and other elements related to performing the function(s) described herein, or these elements can be separate from optical sensor 210. In other words, functionality is described herein for sensing information, for analyzing that information, and for using that information. Some or all of that functionality can be performed by optical sensor 210, or by optical sensor 210 in combination with other elements.

One of the functions of optical sensor 210 is to detect the marks 204 located on either or both ends of roller 202. In general, the marks 204 are visible to the optical, sensor 210 within the range of motion of the optical sensor 210. Significantly, in the present embodiment, the marks 204 are visible to optical sensor 210 as the print media 107 is transported through the feed mechanism 200 and around the roller 202. Although the marks 204 are illustrated as having a particular shape and placement, other shapes and patterns of marks can be used.

The marks 204 are in fixed and known locations on the roller 202. Alternatively, the marks are separated from each other by distances that are known. The marks 204 provide a mechanism for calibrating the location of optical sensor 210, and hence the location of printhead 212, relative to the print media 107. Furthermore, the edge 206 of the print media 107 can also be used as a beacon for calibrating the location of optical sensor 210 and printhead 212. Accordingly, more precise navigation of the printhead 212 relative to the print media 107 is achieved. Importantly, precision is increased without a concomitant increase in the size of the photo array.

In operation, locating the optical sensor 210 and the printhead 212 is achieved as follows. Before printing begins, one of the marks 204 or the paper edge 206 is used to calibrate the position of optical sensor 210, and hence printhead 212, relative to the print media 107. At periodic intervals during printing, the position of optical sensor 210 and printhead 212 relative to the print media 107 can be calibrated using the same mark or a different one, or perhaps using again the paper edge.

For example, during printing, optical sensor 210 and printhead 212 will travel toward either end of roller 202 as they traverse print media 107. Alternatively, at periodic intervals, the optical sensor 210 can be directed to travel to an end of the roller 202 for calibration. Each time optical sensor 210 is within visual range of a mark 204, calibration can be performed. As a result of the calibration, the optical sensor 210 and the printhead 212 are precisely located relative to the print medium 107.

Between calibrations, in one embodiment, optical sensor 210 and printhead 212 can navigate print media 107 using other techniques known in the art. For example, optical sensor 210 can read the features and patterns of the print media 107 to determine displacement of the print media 107. At high magnification, print media 107 is not uniform, and optical sensor 210 can detect patterns in the print media 107 to identify its location on the page. As another example, optical sensor 210 can take successive images of the alphanumeric characters printed on print media 107. The difference between two consecutive images can be used to determine the distance traveled by the optical sensor 210, so that its location can be determined. Any error in location introduced using these techniques can be corrected by a subsequent calibration of the optical sensor 210 and printhead 212 using one of the marks 204. In addition, navigational accuracy can be improved between calibrations as described below.

Figure 2B:
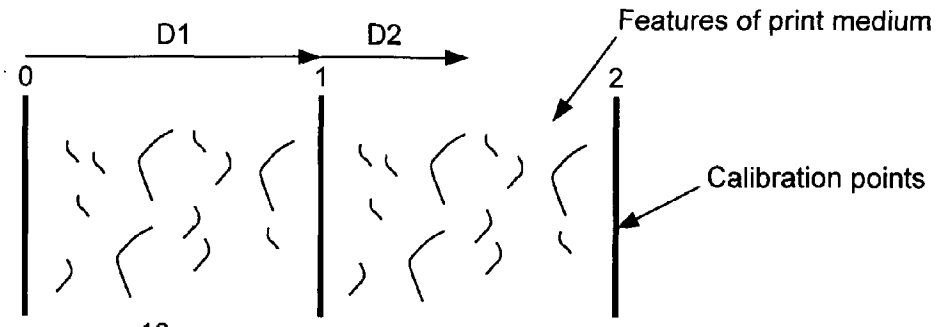
FIG. 2B illustrates a technique for quantifying and correcting positioning errors according to one embodiment of the present invention.

FIG. 2B illustrates a technique for quantifying and correcting positioning errors according to one embodiment of the present invention. In FIG. 2B, the vertical lines identify calibration points. As described by FIG. 2A, the calibration points can be implemented as marks 204 situated in a location visible to the optical sensor 210 (e.g., at one end or both ends of the roller 202).

The optical sensor 210 of FIG. 2A is calibrated at point 0 of FIG. 2B. During printing, the optical sensor 210 traverses the surface of print media 107 and uses the features of the paper to estimate the distance traveled. At the next calibration point 1, optical sensor 210 has actually traveled a distance D1 of 10 centimeters (cm) (that is, the calibration marks 204 are 10 cm apart). However, based on the features of the paper, optical sensor 210 has estimated that a distance of 9.8 cm has been traveled (note that the degree of error is exaggerated).

Optical sensor 210 is again calibrated at point 1. Because the degree of error is now known based on the above, the position of optical sensor 210 can be corrected as it travels a distance D2 before the next calibration at point 2. Using the example above, D2(actual)=D2(estimated)*(10/9.8). Thus, the navigational accuracy of optical sensor 210 is improved by calibration, even between calibration points.

Figure 3A:
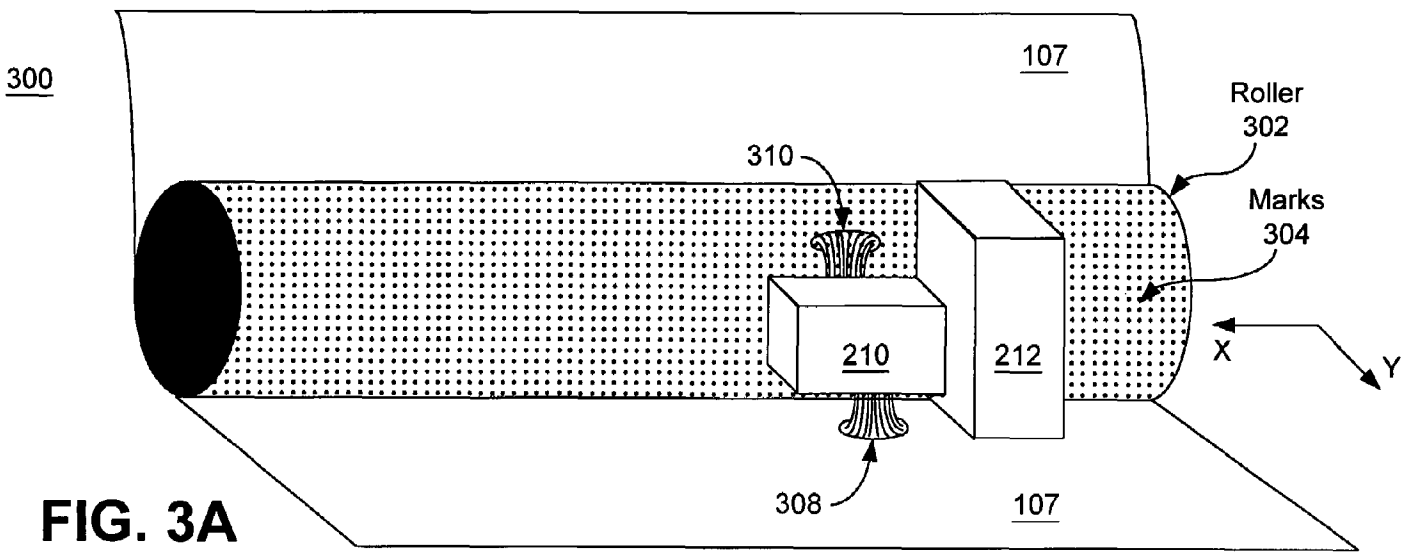
FIG. 3A illustrates a print medium feed mechanism with navigation marks according to one embodiment of the present invention.

FIG. 3A illustrates a print medium feed mechanism 300 with navigation or calibration marks 304 according to another embodiment of the present invention. In this embodiment, print media 107 travels under roller 302 in the general direction Y. Optical sensor 210 and printhead 212 travel along axis X in a direction that is essentially orthogonal to the direction Y.

In the present embodiment, the marks 304 occur along the entire length of the roller 302 (or substantially along the length of roller 302). The marks 304 are located at fixed and known positions that are visible to optical sensor 210. Alternatively, the marks are separated from each other by distances that are known. Note that the marks 304 remain visible to optical sensor 210 as print media 107 is transported through feed mechanism 300. Although the marks 304 are illustrated as having a particular shape and placement, other shapes and patterns of marks can be used.

Using the marks 304, the position of optical sensor 210 and hence of printhead 212 relative to the print media 107 can be accurately determined on essentially a continuous basis. Accordingly, it is not necessary to navigate using the features of the print media 107. However, in the embodiment of FIG. 3A, optical sensor 210 can sense information 310 on roller 302 for navigation, and information 308 on print media 107 for monitoring ink dot density or ink dot position, for example.

Figure 3B:
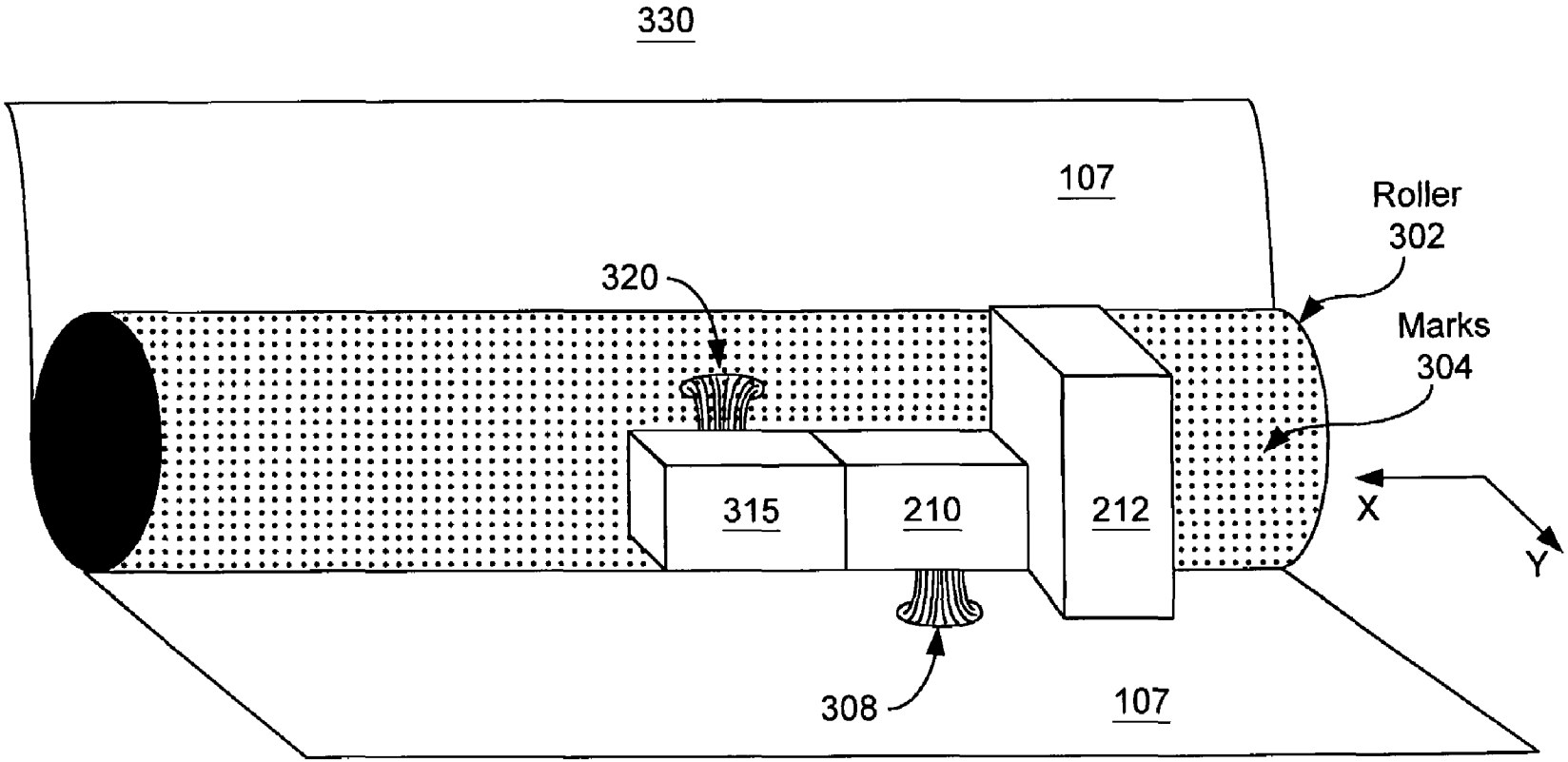
FIG. 3B illustrates the print medium feed mechanism of FIG. 3A with an additional optical sensor according to one embodiment of the present invention.

FIG. 3B illustrates a print medium feed mechanism 330 according to yet another embodiment of the present invention. The feed mechanism 330 is similar to that of FIG. 3A, but includes an additional optical sensor 315. In this embodiment, optical sensor 315 is for sensing information 320 on roller 302 for navigation, and optical sensor 210 is for sensing information 308 on print media 107 (e.g., ink dot density or ink dot position).

Figure 4:
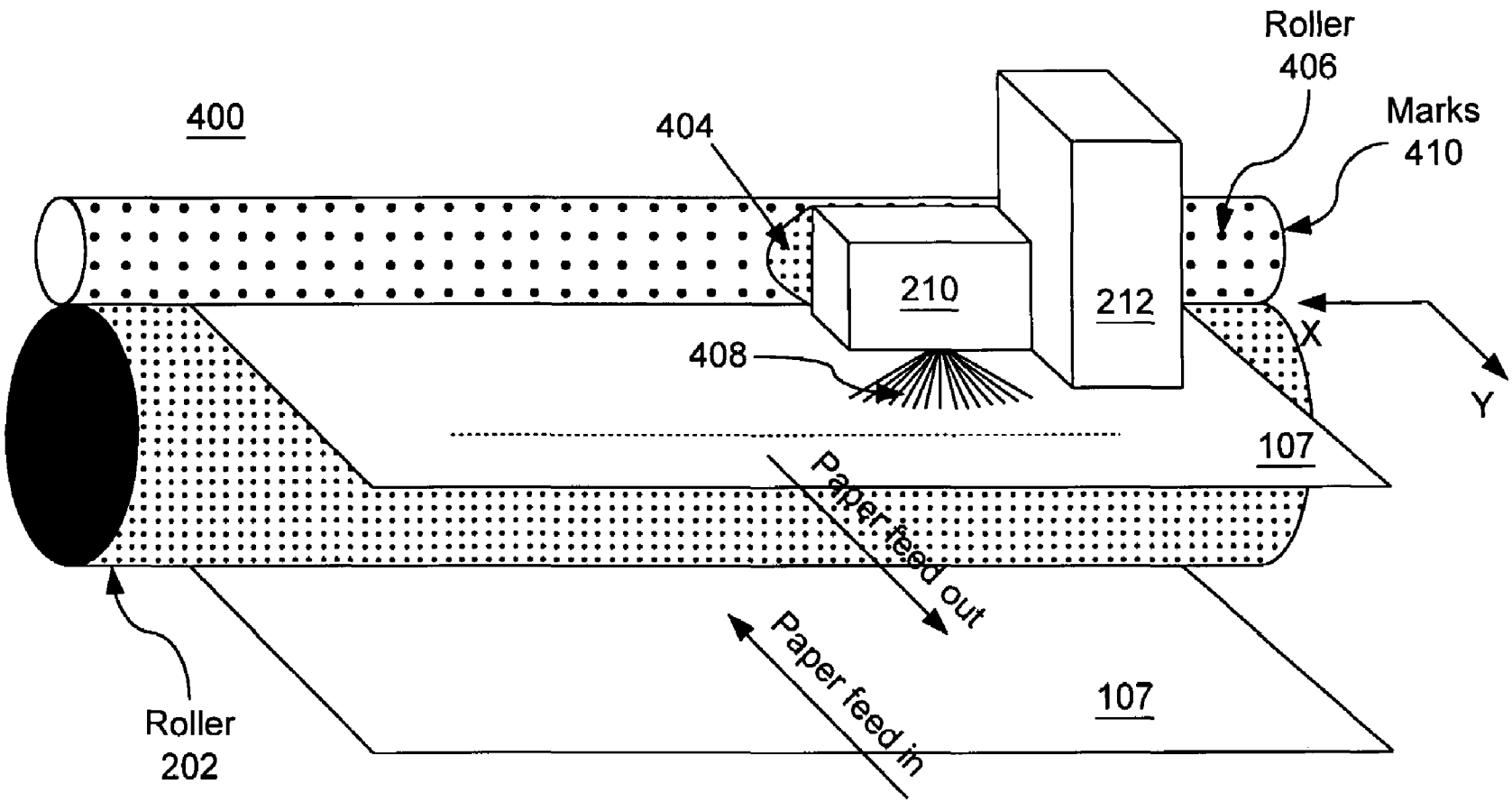
FIG. 4 illustrates a print medium feed mechanism with navigation marks according to another embodiment of the present invention.

FIG. 4 illustrates a print medium feed mechanism 400 with navigation marks 410 according to still another embodiment of the present invention. In this embodiment, feed mechanism 400 includes a roller 402 and another (e.g., auxiliary) roller 406. In the present embodiment, the marks 410 occur along the entire length of the roller 406 (or substantially along the length of roller 406). The marks 410 are located at fixed and known positions that are visible to optical sensor 210. Alternatively, the marks are separated from each other by distances that are known. Note that the marks 410 remain visible to optical sensor 210 as print media 107 is transported through feed mechanism 400. Although the marks 410 are illustrated as having a particular shape and placement, other shapes and patterns of marks can be used.

Using the marks 410, the position of optical sensor 210 and hence of printhead 212 relative to the print media 107 can be accurately determined on essentially a continuous basis. Although roller 402 and roller 406 may have different diameters, the rate at which print media 107 is fed and the rate at which the surface of roller 406 moves are the same, and so the marks 410 on roller 406 can be used for navigating on input media 107. Accordingly, it is not necessary to navigate using the features of the print media 107. However, in the embodiment of FIG. 4, optical sensor 210 can sense information 404 on roller 406 for navigation, and information 408 on print media 107 for monitoring ink dot density or ink dot position, for example.

It is appreciated that, in an alternative embodiment, feed mechanism can include an additional optical sensor in a manner similar to that described above in conjunction with FIG. 3B. In such an embodiment, one optical sensor would be used for navigation while the other would be used for sensing information from the print media.

Figure 5:
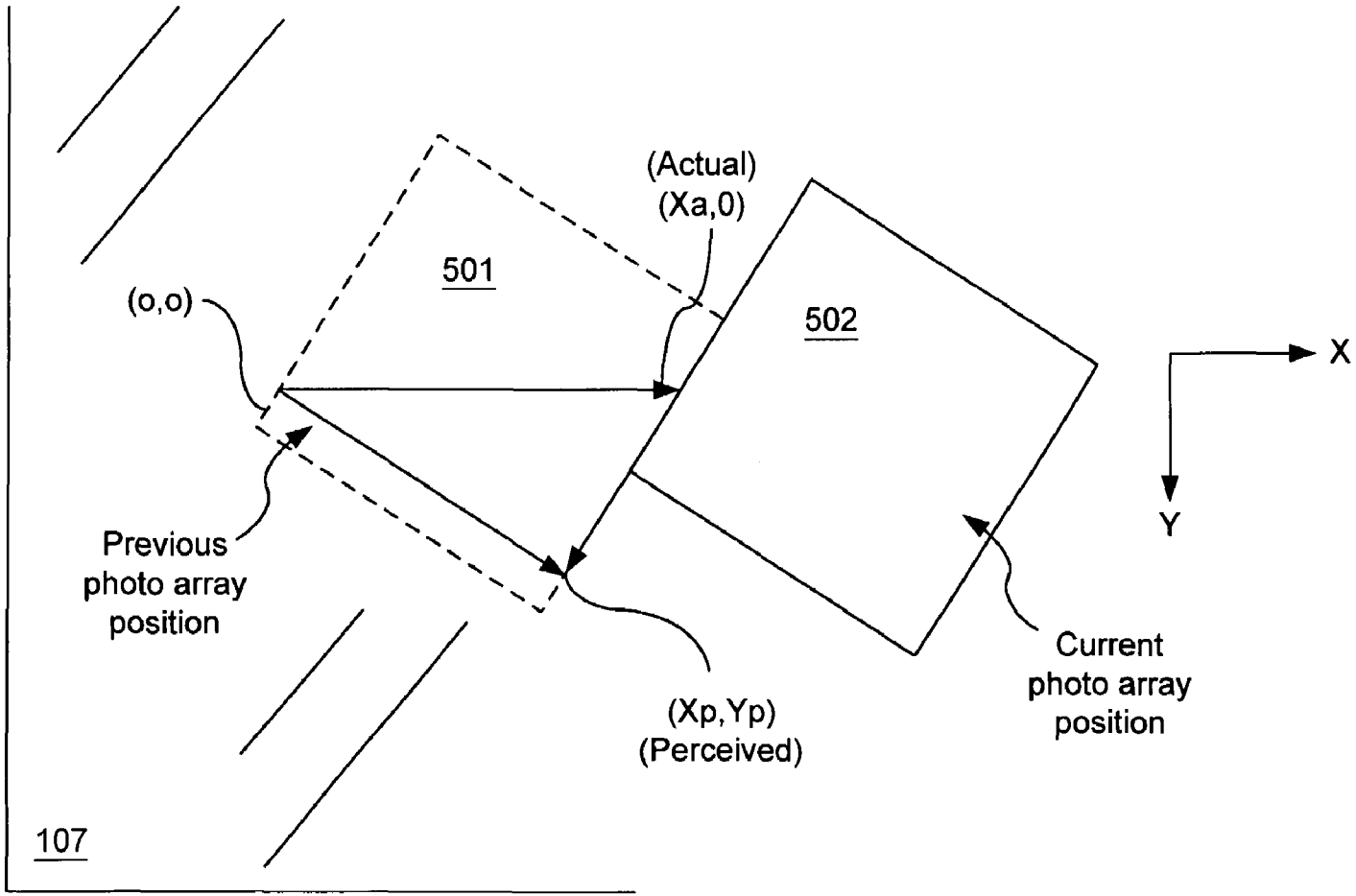
FIG. 5 illustrates a technique for detecting and correcting optical sensor rotational mounting errors according to one embodiment of the present invention.

FIG. 5 illustrates a technique for detecting and correcting a rotational mounting error between an optical sensor and a printhead according to one embodiment of the present invention. FIG. 5 illustrates, in an exaggerated fashion, an instance in which the optical sensor 210 (of FIG. 2A, for example) is rotated relative to printhead 212 and also relative to the print media 107. For the purposes of this discussion, it is assumed that the printhead 212 is in a proper orientation relative to print media 107. However, the printhead 212 could instead be rotated relative to optical sensor 210 and also relative to print media 107, with optical sensor 210 in proper orientation relative to print media 107. Recall that the optical sensor 210 and the printhead 212 move in combination.

FIG. 5 shows a first (e.g., previous) photo array position 501 and a subsequent (e.g., current) photo array position 502. In the example of FIG. 5, the initial position of the photo array (e.g., optical sensor) can be referred to as (0,0). As described above, the optical sensor and the printhead move along an axis X. As such, if the photo array moves a distance of $x_a$ from position 501 to position 502, then the actual current position of the photo array can be referred to as ($x_a$, 0).

In the present embodiment, an axis signal is introduced to identify the relative direction of motion between the photo array and printhead (moving in tandem) and the print media 107. The direction of relative motion between the photo array/printhead and the print media 107 is limited to either the X direction (when the photo array/printhead is moving) or the Y direction (when the print media is moving). Generally, motion only occurs along one axis at a time. Thus, the axis signal identifies whether the direction of relative motion is in the X direction or in the Y direction. For the example being discussed, the axis signal would identify the direction of relative motion as the X direction.

Based on the features of the print media 107, the perceived current position of the photo array is ($x_p$, $y_p$). For example, as mentioned above, the printhead can be properly oriented relative to print media-107, and hence alpha-numeric characters printed on print media 107 will be properly aligned on print media 107. Because of its rotated orientation relative to the printhead, the optical sensor will perceive itself as having moved diagonally relative to the proper alignment of the alpha-numeric characters printed on print media 107.

Based on the axis signal, a controller or processor or like device recognizes, for the example being described, that the direction of relative motion should have been along the X axis. Accordingly, the presence of a value other than zero for $y_p$ indicates the presence of a rotational error. The correct (actual) distance traveled in the X direction can be calculated as $x_a=(x_p^2+y_p^2)^{1/2}$.

A similar approach can be used to determine the correct distance traveled in the Y direction when the axis signal indicates that the relative direction of motion should have been along the Y axis. In that case, the correct (actual) distance traveled in the Y direction can be calculated as $y_a=(y_p^2-x_p^2)^{1/2}$.

Figure 6:
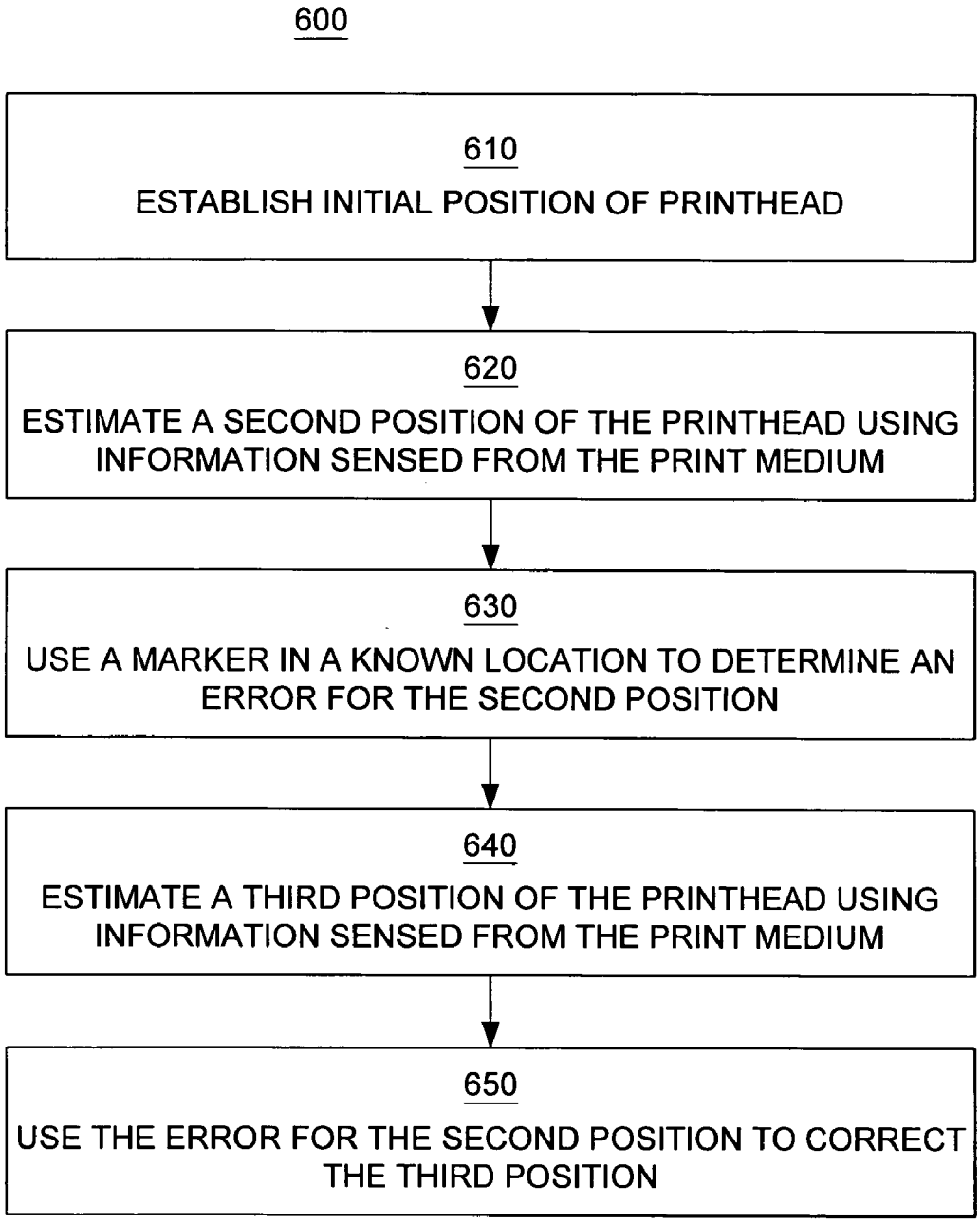
FIG. 6 is a flowchart of a method for correcting a position of a printhead according to one embodiment of the present invention.

FIG. 6 is a flowchart 600 of a method for correcting a position of a printhead in a printer system according to one embodiment of the present invention. Although specific steps are disclosed in flowchart 600, such steps are exemplary. That is, embodiments of the present invention are well suited to performing various other steps or variations of the steps recited in flowchart 600. It is appreciated that the steps in flowchart 600 may be performed in an order different than presented.

In step 610, the initial position of the printhead relative to a print medium is established. The initial position of the printhead can be established using an optical sensor that is coupled to the printhead. The optical sensor is used to sense a mark that is in a fixed and known location. For example, the mark can be located on a roller of an input media feed mechanism of the printer system. Alternatively, the initial position of the printhead can be established using, for example, the edge of the paper sensed by the optical sensor.

In step 620, a second (subsequent) position of the printhead is estimated using information from the print medium. For example, as previously described herein, information printed on the print medium or the features of the print medium itself (e.g., patterns embedded in the texture of the paper) can be used to estimate how far the printhead has traveled.

In step 630, an error associated with the estimated (second) position is determined using a marker in a known location. The error can be determined by calibrating the position of the printhead against a mark in a fixed and known location.

In step 640, a third (subsequent to the second) position of the printhead is estimated using information from the print medium. For example, as previously described herein, information printed on the print medium or the features of the print medium itself can be used to estimate how far the printhead has traveled.

In step 650, the error determined in step 630 can be applied to the estimated (third) position to more accurately locate the printhead relative to the print medium.

Figure 7:
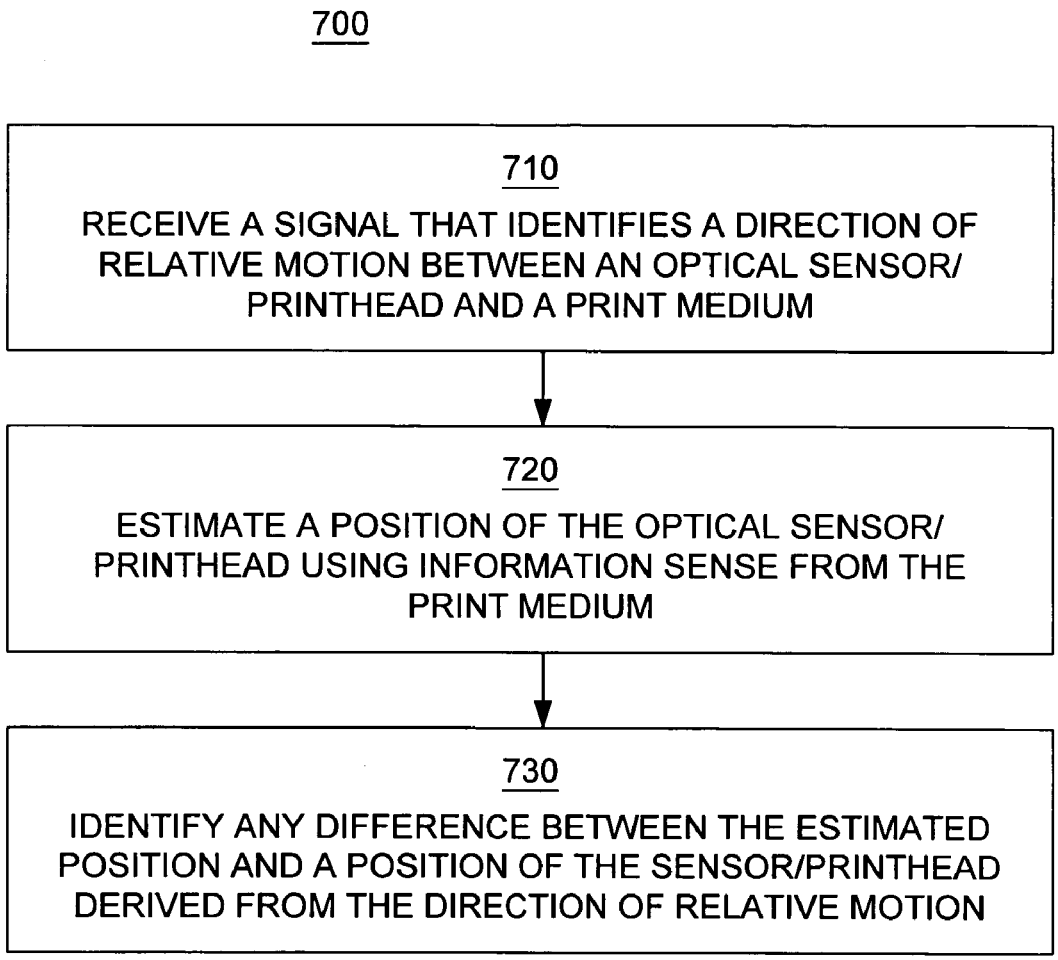
FIG. 7 is a flowchart of a method for detecting a rotational mounting error between an optical sensor and a printhead according to one embodiment of the present invention.

FIG. 7 is a flowchart 700 of a method for detecting a rotational mounting error between an optical sensor and a printhead according to one embodiment of the present invention. Although specific steps are disclosed in flowchart 700, such steps are exemplary. That is, embodiments of the present invention are well suited to performing various other steps or variations of the steps recited in flowchart 700. It is appreciated that the steps in flowchart 700 may be performed in an order different than presented.

In step 710, a signal is received. The signal identifies a direction of relative motion between an optical sensor and printhead (moving in combination) and a print medium. In one embodiment, the print medium moves in a first direction (e.g., the Y direction) and the optical sensor/printhead moves in a second direction (e.g., the X direction) orthogonal to the first direction. In such an embodiment, the signal identifies whether movement is in the X direction (when the optical sensor/printhead is moving) or in the Y direction (when the print medium is moving).

In step 720, the position of the optical sensor/printhead is estimated using information sensed from the print medium. For example, as previously described herein, information printed on the print medium or the features of the print medium itself (e.g., patterns embedded in the texture of the paper) can be used to estimate how far the optical sensor/printhead has traveled.

In step 730, any difference between the estimated position and a position derived from the direction of travel indicated by the signal of step 710 would indicate that there is a rotational error between the optical sensor and the printhead. For example, if the signal indicates that the optical sensor/printhead moved in the X direction, but the estimated position indicates that there was also movement in the Y direction, then it can be deduced that a rotational error is present. Once the presence of a rotational error is identified, the rotational error can be corrected as previously described herein.

In summary, embodiments of the present invention provide methods and systems for improving navigation accuracy without increasing the size of the photo array.

Embodiments of the present invention are thus described. While the present invention has been described in particular embodiments, it should be appreciated that the present invention should not be construed as limited by such embodiments, but rather construed according to the following claims.

What is claimed is:

1. A system for printing, said system comprising:

a first optical sensor that is moveable relative to a print medium;

a printhead that is coupled to and moves in tandem with said first optical sensor;

a second optical sensor that is coupled to and moves in tandem with both said first optical sensor and said printhead; and a print medium feed mechanism comprising a roller, wherein said first optical sensor senses information on said roller and said second optical sensor concurrently senses information on said print medium;

wherein said roller has located thereon a plurality of marks, said marks occurring along the circumference of said roller and also along the length of said roller and visible to said first optical sensor within the range of movement of said first optical sensor as said print medium is fed through said feed mechanism past said roller, said marks separated by known distances measured in a first direction along said circumference and known distances measured in a second direction along said length, wherein said known distances measured in said first direction and in said second direction are used to determined a position of said printhead relative to said print medium.

2. The system of claim 1 wherein said marks along said length of said roller are visible to said first optical sensor during transport of said print medium, wherein said print medium is opaque.

3. The system of claim 1 wherein said feed mechanism comprises a second roller.

4. The system of claim 1 wherein said position is used for determining a rotational mounting error associated with said printhead and said first optical sensor.

5. The system of claim 1 wherein said position of said first optical sensor is used to establish a position of said printhead.

6. A method of correcting a position of a printhead in a system for printing, said method comprising:

establishing an initial position of said printhead;

estimating a second position of said printhead based on information sensed as said printhead moves relative to a print medium, wherein said system comprises a feed mechanism for transporting said print medium, said feed mechanism comprising a roller; and using a first marker in a known location on said roller to determine an error associated with said second position.

7. The method of claim 6 further comprising:

estimating a third position of said printhead based on information sensed as said printhead moves relative to said print medium; and using said error associated with said second position to correct said third position.

8. The method of claim 6 wherein said initial position is established using said first marker.

9. The method of claim 6 wherein said initial position is determined using an edge of said print medium.

10. The method of claim 6 wherein said initial position is established using a second marker.

11. The method of claim 6 wherein said printhead moves in combination with an optical sensor, said optical sensor adapted to detect said first marker.

12. The method of claim 6 wherein said feed mechanism further comprises a second roller, wherein said first marker is located on one of said rollers.

13. A method of detecting rotational mounting error between an optical sensor and a printhead in a system for printing, said method comprising:

receiving a signal that identifies a direction of relative motion between said optical sensor and printhead moving in combination and a print medium;

estimating a position of said optical sensor and printhead using information sensed from said print medium; and identifying any difference between a position of said optical sensor and printhead based on said direction of relative motion and said position of said optical sensor and printhead estimated using said information sensed from said print medium, said any difference indicating presence of a rotational mounting error.

14. The method of claim 13 wherein said print medium moves in a first direction along a first axis and said optical sensor and printhead move in a second direction along a second axis orthogonal to said first axis, wherein said signal is for identifying whether said direction of relative motion is in said first direction or in said second direction.

15. The method of claim 13 further comprising:

correcting for said rotational mounting error if said any difference is identified.

16. The method of claim 13 further comprising:

using a feature having a known location to establish an initial position of said optical sensor and printhead.

17. The method of claim 13 further comprising:

using a feature having a known location to determine an error associated with said position of said optical sensor and printhead estimated using said information sensed from said print medium.

* * * * *